US007013613B1

(12) United States Patent
Boellner et al.

(10) Patent No.: US 7,013,613 B1
(45) Date of Patent: Mar. 21, 2006

(54) COMPOSITE SLAB AND JOIST ASSEMBLY AND METHOD OF MANUFACTURE THEREOF

(75) Inventors: Russell A. Boellner, Baldwin, MD (US); David E. Swirnow, Owings Mills, MD (US)

(73) Assignee: Swirnow R & D, LLC, Baltimore, MD (US)

( * ) Notice: Subject to any disclaimer, the term of this patent is extended or adjusted under 35 U.S.C. 154(b) by 0 days.

(21) Appl. No.: 10/630,464

(22) Filed: Jul. 30, 2003

Related U.S. Application Data

(60) Provisional application No. 60/400,205, filed on Jul. 31, 2002.

(51) Int. Cl.
*E04C 3/30* (2006.01)

(52) U.S. Cl. ..... 52/729.2; 52/692

(58) Field of Classification Search ..... 52/414, 52/450, 636, 637, 638, 643, 692, 693, 694, 52/649.1, 220.1, 220.5, 729.1, 729.2, 730.1, 52/730.2; 249/210, 26
See application file for complete search history.

(56) References Cited

U.S. PATENT DOCUMENTS 1,863,817 A * 6/1932 Wells ..... 52/693
2,061,103 A * 11/1936 Roberts ..... 52/692
2,860,743 A * 11/1958 Cliff ..... 52/692
3,527,007 A * 9/1970 McManus ..... 52/327
3,686,819 A * 8/1972 Atkinson ..... 52/693
3,845,594 A 11/1974 Butts et al.
4,106,256 A * 8/1978 Cody ..... 52/646
4,700,519 A 10/1987 Person et al.
4,937,998 A * 7/1990 Goldberg ..... 52/729.5
5,544,464 A * 8/1996 Dutil ..... 52/330

* cited by examiner

*Primary Examiner*—Naoko Slack
(74) *Attorney, Agent, or Firm*—Armstrong, Kratz, Quintos, Hanson & Brooks, LLP

(57) ABSTRACT

A composite slab and joist assembly includes a joist, at least one deck panel on the joist, slab reinforcement above the joist and dock panel, and a slab of concrete formed on the deck panel and joist such that the slab encloses the slab reinforcement and a top portion of the joist. The joist includes a bottom chord, a top chord, and a web affixed therebetween. The top chord has first and second structural angles. The first structural angle has in cross-section a horizontally-extending leg and an upwardly-extending leg meeting at a corner. The second structural angle has in cross-section a horizontally-extending leg and a downwardly-extending leg meeting at a corner. The upper portion of the web is joined to the second structural angle against the downwardly-extending leg.

15 Claims, 13 Drawing Sheets

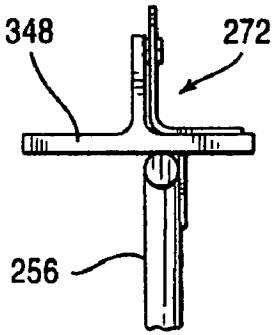
FIG.10
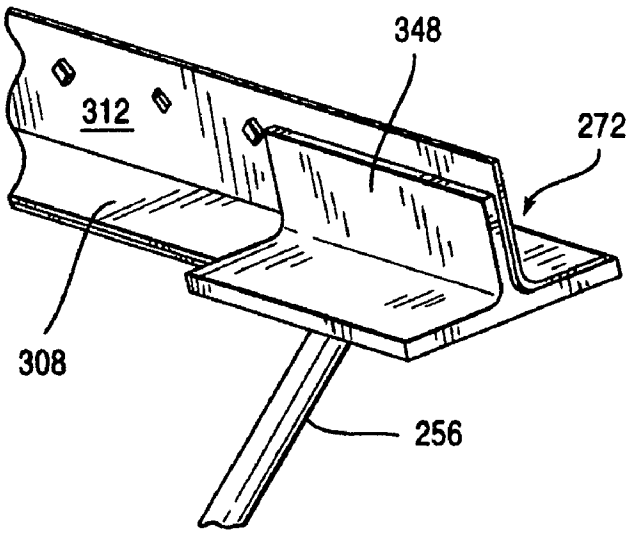
FIG.9
FIG.8
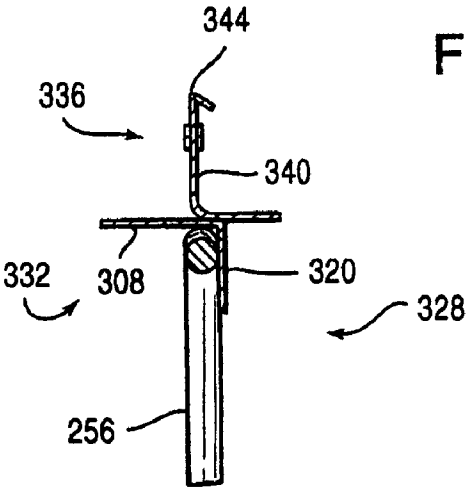

COMPOSITE SLAB AND JOIST ASSEMBLY AND METHOD OF MANUFACTURE THEREOF

RELATED APPLICATION

This application claims priority under 35 U.S.C. § 119(e) to U.S. Provisional Application No. 60/400,205, filed Jul. 31, 2002, which is hereby incorporated by reference in its entirety.

FIELD OF THE INVENTION

The present invention relates to composite structure construction, and more particularly to a composite slab and joist assembly.

BACKGROUND

The prior art is replete with examples of composite structure constructions employing composite slab and joist assemblies. In many of these examples, the slabs of concrete are positioned on the joists, and, during construction, to support the newly-poured unset concrete that will become parts of the slabs, forms for the concrete are mounted between adjacent joists of the assemblies.

Butts et al. (U.S. Pat. No. 3,845,594) discloses an example of a composite slab and joist assembly in which the forms for the unset concrete are made of plywood. After the concrete hardens, the plywood is removed and reused.

Other methods of forming composite slab and joist assemblies employ metal deck panels for concrete forms in place of wood, and the deck panels remain as parts of the assemblies. When metal deck panels are used, labor for removing wooden forms is unnecessary, and, by not using wood to construct the composite slab and joist assemblies, the number of trades required for the construction is fewer. Thus, constructing the assemblies using metal deck panels eliminates some of the labor costs.

Person et al. (U.S. Pat. No. 4,700,519) discloses an example of a composite slab and joist assembly employing metal deck panels. With reference to the perspective view of FIG. 1 and the corresponding cross-section in FIG. 2, a composite slab and joist assembly 100 typically includes a slab 104 and a plurality of joists 108. Slab 104 may be formed of concrete with reinforcement, such as reinforcing steel mesh 112, enclosed therein. Each joist 108 includes a bottom chord 116, a top chord 120, and an open web 124 affixed therebetween, and web 124 typically comprises a series of adjacent triangulating compression and tension members 128.

FIGS. 1 and 2 show that both bottom chord 116 and top chord 120 comprise two elongated structural angles 132,136 and 140,144, respectively. Structural angles are sometimes referred to as "angle bars." Structural angles are readily-available commodities, which may be cold-formed or hot-rolled.

In the example of FIGS. 1 and 2, structural angles 132,136 of bottom chord 116 are oriented so that each has in cross-section an upwardly-extending leg 148,152 and a horizontally-extending leg 156,160 meeting at a corner 164,168. Structural angles 132,136 are joined in a parallel relationship at the same height to opposite sides of web 124. Web 124 joins structural angles 132,136 along the surfaces of upwardly-extending legs 148,152. Structural angles 132, 136 are situated such that horizontally-extending legs 156, 160 extend outwardly from web 124.

As shown also in the FIG. 3 close-up of a cross-section of top chord 120, structural angles 140,144 are also oriented so that each has, in cross-section, an upwardly-extending leg 172,176 and a horizontally-extending leg 180,184 meeting at a corner 188,192. Unlike in bottom chord 116, however, the top chord 120 upwardly-extending legs 172,176 are directly joined "back-to-back" without web 124 positioned therebetween. Instead, web 124 is joined below at junction 196 adjacent corners 188,192. As with bottom chord 116, structural angles 140,144 of top chord 120 are situated such that horizontally-extending legs 180,184 extend outward from corners 188,192.

To form assembly 100, a plurality of joists 108 are spaced apart on supporting members, such as building girders, beams, or walls, and deck panels 200, typically formed of rolled corrugated steel, are positioned therebetween. As shown in FIGS. 1 and 2, deck panels 200 are supported at opposite edges by horizontally-extending legs 180,184 of top chords 120. Such an arrangement facilitates the proper horizontal spacing of joists 108 on the supporting members. Deck panels 200 are then secured to top chords 120.

Reinforcing mesh 112 is placed on deck panels 200. As shown also with reference to FIGS. 1 and 2, upwardly-extending legs 172,176 of top chords 120 act as "high-chairs" to raise mesh 112 to a higher position directly above joists 108. With mesh 112 in place, concrete is poured thereon and on deck panels 200 to form slab 104 of composite slab and joist assembly 100.

As is apparent in FIGS. 1–3, structural angles 140,144 of top chord 120 are not identical in dimension, because upwardly-extending leg 176 of structural angle 144 extends higher than upwardly-extending leg 172 of structural angle 140. The reason for this configuration is that upwardly-extending leg 176 has a series of transverse concrete-engaging deformations 204, which act as sheers connector to transfer compression forces from top chord 120 to concrete slab 104. Accordingly, with this configuration, upwardly-extending leg 176 of structural angle 144 must extend upward beyond the upper extant of upwardly-extending leg 172.

Referring in particular to FIGS. 2 and 3, it is apparent that the surface area is limited at junction 196 for butt-welding web 124 to top chord 120. Accordingly, such a configuration limits the surface area available for the welded connection.

Dutil (U.S. Pat. No. 5,544,464) discloses a configuration that overcomes this problem. As shown in FIGS. 4 and 5, a joist 208 has a top chord 212, which includes a structural element 216 with a upwardly-extending segment 220 that offers a greater surface area for joining to a web 224. Structural element 216 also has a horizontally-extending leg 228 for supporting an edge 232 of a deck panel 236.

For joist 208 to support an edge 232 of a deck panel 236 on the opposite side from structural element 216, a structural angle 240 is added so that structural element 216 aid structural angle 240 enclose the top of web 224 therebetween. However, for welding structural angle 240 to web 224, access is limited due to the positioning of structural element 216. Consequently, it is difficult to weld structural angle 240 sufficiently to develop its working capacity beyond supporting a deck panel 236. Also, additional reinforcement of top chord 212 may be necessary to reinforce joist 208 during the non-composite stage (before the concrete sets), thus requiring more material and additional formation steps. For example, the top chord may be reinforced by welding steel to the "S"-shaped section.

Accordingly, to the best knowledge of the present inventors, there is an unmet need for an economical composite slab and joist assembly in which the joist top chords have segments which extend vertically into the concrete slab and simultaneously have segments that extend vertically, whether upwardly or downwardly, offering expanded surface area for joining to joist webs in such a configuration with sufficient access for attachment of the webs to the corresponding top chords to thereby develop greater working capacity, that is, greater ability to support loads over the life of the structure.

SUMMARY OF THE INVENTION

A general objective of the present invention is to provide a composite slab and joist assembly that overcomes the aforementioned problems of the prior art. The composite slab and joist assembly of the present invention is suitable, not only for floors, but also for roofs and ceiling structures.

The present invention may be embodied as a joist formed as combination of a bottom chord, a top chord, and a web affixed therebetween. The top chord is formed from a first elongated structural angle and a second elongated structural angle. The first structural angle is oriented so that, in cross-section, it has a horizontally-extending leg ad an upwardly-extending leg meeting at a corner. The second structural angle is oriented so that, in cross section, it has a horizontally-extending leg and a downwardly-extending leg meeting at a corner. The joist elements are assembled such that an upper portion of the web is joined to the top chord second structural angle against the downwardly-extending leg, and the first structural angle is joined to the second structural angle. The structural angles of the top chord may be joined together in any of top-to-bottom, back-to-back, and corner-to-corner relationships.

The present invention has additional aspects. For example, the joist first structural angle may have, at a top portion of the upwardly-extending leg, a bend in cross-section.

Also, at a longitudinal end of the top chord, the joist may have a shoe. The shoe may have a T-shaped cross-section, wherein the top chord second structural angle, at the longitudinal end, is coped to allow the shoe to be attached to the first and second structural angles to be flush with a longitudinal end of the first structural angle.

Additionally, the joist may have, in its upwardly-extending leg of the top chord first structural angle, a series of transverse protrusions and indentations such that a protrusion on one side of the upwardly-extending leg has a corresponding indentation located transversely on the opposite side of the upwardly-extending leg, with the protrusion and corresponding indentation each located at the same longitudinal position along the length of the top chord. On each side of the upwardly-extending leg of the first structural angle, the protrusions may be positioned longitudinally adjacent the indentations, and the indentations may be positioned longitudinally adjacent the protrusions.

As another aspect of the present invention, the joist may have a top chord that has at least one splice in one of its structural angles. Additionally, both structural angles of the top chord may have splices that are longitudinally offset from each other along the length of the top chord.

The joist of the present invention may be formed with a web that has a series of adjacent compression and tension members. The web may further be formed with two series of adjacent compression and tension members having a gap therebetween.

The present invention may also be embodied as a composite slab and joist assembly that is formed as combination of a joist, at least one deck panel, slab reinforcement, and a slab of concrete. The joist may be formed as described above. The deck panel is positioned on one of the horizontally-extending legs of the top chord of the joist. The slab reinforcement, which may be a mesh, is positioned above the joist and the deck panel. The slab of concrete is formed on the deck panel and the top of the joist such that the slab encloses the slab reinforcement and a top portion of the joist.

The present invention may further be embodied as a method of manufacturing a joist. The method would include: orienting first and second elongated structural angles so that, in cross-section, the first structural angle has a horizontally-extending leg and an upwardly-extending leg meeting at a corner, and the second structural angle has a horizontally-extending leg and a downwardly-extending leg meeting at a corner; joining the first structural angle to the second structural angle to form a top chord; joining an upper portion of a web to the second structural angle against the downwardly-extending leg; and joining a bottom chord to a bottom portion of the web.

The method of the present invention has additional aspects. For example, the method may include: adding a series of transverse protrusions and indentations to the upwardly-extending leg of the first structural angle. A protrusion on one side of the upwardly-extending leg may have a correspondingly indentation located transversely on the opposite side of the upwardly-extending leg, and the protrusion and corresponding indentation may each be located at the same longitudinal position along the length of the top chord. Further, on each side of the upwardly-extending leg of the first structural angle, the protrusions may be added longitudinally adjacent the indentations, and the indentations may be added longitudinally adjacent the protrusions. The transverse protrusions and indentations may be added by stamping the first structural angle.

Alternatively, the protrusions and indentations may be added by inserting the first structural angle between a pair of counter: rotating dies, each having at least one protrusion and at least one indentation. The dies would be set so that a protrusion from one die and an indentation from the other die simultaneously deform the first structural angle there between to add a protrusion and a corresponding indentation.

The present invention may also be embodied as a method of manufacturing a composite slab and joist assembly. The method would include: manufacturing a joist; positioning at least one deck panel on a horizontally-extending leg of a top chord of the joist; positioning slab reinforcement above the joist and the deck panel; and forming a slab of concrete on the deck panel and on the top of the joist to enclose the slab reinforcement and the joist. The joist may be formed as described above.

The present invention is an improvement over prior art steel and concrete structures that have at least one pair of spaced-apart parallel joists, each of which includes at least a top chord, and where a wooden form is mounted between the respective top chords of the pair of joists for subsequently pouring a concrete slab therebetween, the wooden form subsequently being removed once the concrete has cured. In this improvement, the top chord of each joist has two complementary structural angles including first and second structural angles secured to each other. The first structural angle has an upwardly-extending leg and a horizontally-extending leg forming a first corner therebetween. The second structural angle has a downwardly-extending leg and a horizontally-extending leg forming a second corner therebetween. The horizontally-extending leg of the second structural angle extends in a direction oppositely of the horizontally-extending leg of the first structural angle. The first and second angle members are disposed such that their respective corners substantially engage or confront one another, thereby forming in cross-section a substantially "plus" symbol. A panel is permanently mounted horizontally between the pair of joists, thereby providing a concrete form, and concrete poured over the panel to form a slab. Thus, the present invention eliminates the necessity of constructing, and subsequently removing, a wooden form between the pair of joists.

The above-described improvement has additional aspects. For example, the panel may be a metal corrugated panel. Also, the upwardly-extending legs of the first structural angles may have alternately-disposed protrusions and indentations, which improve the bonding of the joists to the concrete slab. Additionally, each joist may include a bottom chord connected to the top chord by a web. Further, the web may include compression and tension members, each of which has an upper end and a lower end, the respective upper ends being connected to the downwardly-extending leg of the second structural angle, which provides improved structural integrity. The structure may include girders, beams, or walls on which the joists are supported, and wherein a reinforcing shoe is disposed at the respective ends of the joists and contact the girders, beams, or walls of the structure. Also, the bottom chord may include a pair of complementary structural angles having respective upwardly-extending spaced-apart legs for securing therebetween the lower ends of the respective compression and tension members of the web.

As an additional aspect, the present invention is an improvement over prior art building structures that have at least a first joist which includes a top chord, a bottom chord, and a web therebetween that includes compression and tension members, each of which has respective upper and lower ends. In this improvement, the top chord includes at least one structural angle having a horizontally-extending leg and a downwardly-extending leg, and the respective upper ends of the tension and compression members of the are secured to the downwardly-extending leg of the structural angle.

This improvement has additional aspects. For example, the building structure may include an additional structural angle having an upwardly-extending leg and a horizontally-extending leg disposed oppositely to the horizontally-extending leg of the other structural angle. In this configuration, both structural angles members are connected thereto to form, in cross-section, a substantially "plus" configuration. Also, a second joist may be included that is parallel to and spaced apart from the first joist with a corrugated metal panel secured between the respective top chords and with a concrete slab is poured over the corrugated metal panel and between the respective top chords of the first and second joists. Further, the respective upwardly-extending legs of the additional structural angles of the top chords may have respective alternating protrusions and indentations, which improve the bonding of the joists to the concrete slab.

The present invention is described in detail below with reference to the accompanying drawings, which are summarized as follows:

BRIEF DESCRIPTION OF THE DRAWINGS

FIG. 8 is a cross-sectional view of an third alternate embodiment of the joist of FIG. 7;

FIG. 9 is a perspective view showing the shoe attached to the joist of FIG. 6;

FIG. 10 is an end view of the shoe attached to the joist, the figure corresponding to the perspective view of FIG. 9;

DETAILED DESCRIPTION OF THE INVENTION

The invention summarized above and defined by the claims below may be better understood by referring to the present detailed description, which should be read with reference to the accompanying drawings. This detailed description presents preferred embodiments of the present invention. This description is not intended to limit the scope of the claims but instead to provide examples of the invention.

Described first are preferred embodiments of joists configured in accordance with the present invention. Also described are implementations for manufacturing the joists. Then described is a preferred embodiment of a composite slab and joist assembly in accordance with the invention.

Figure 1:
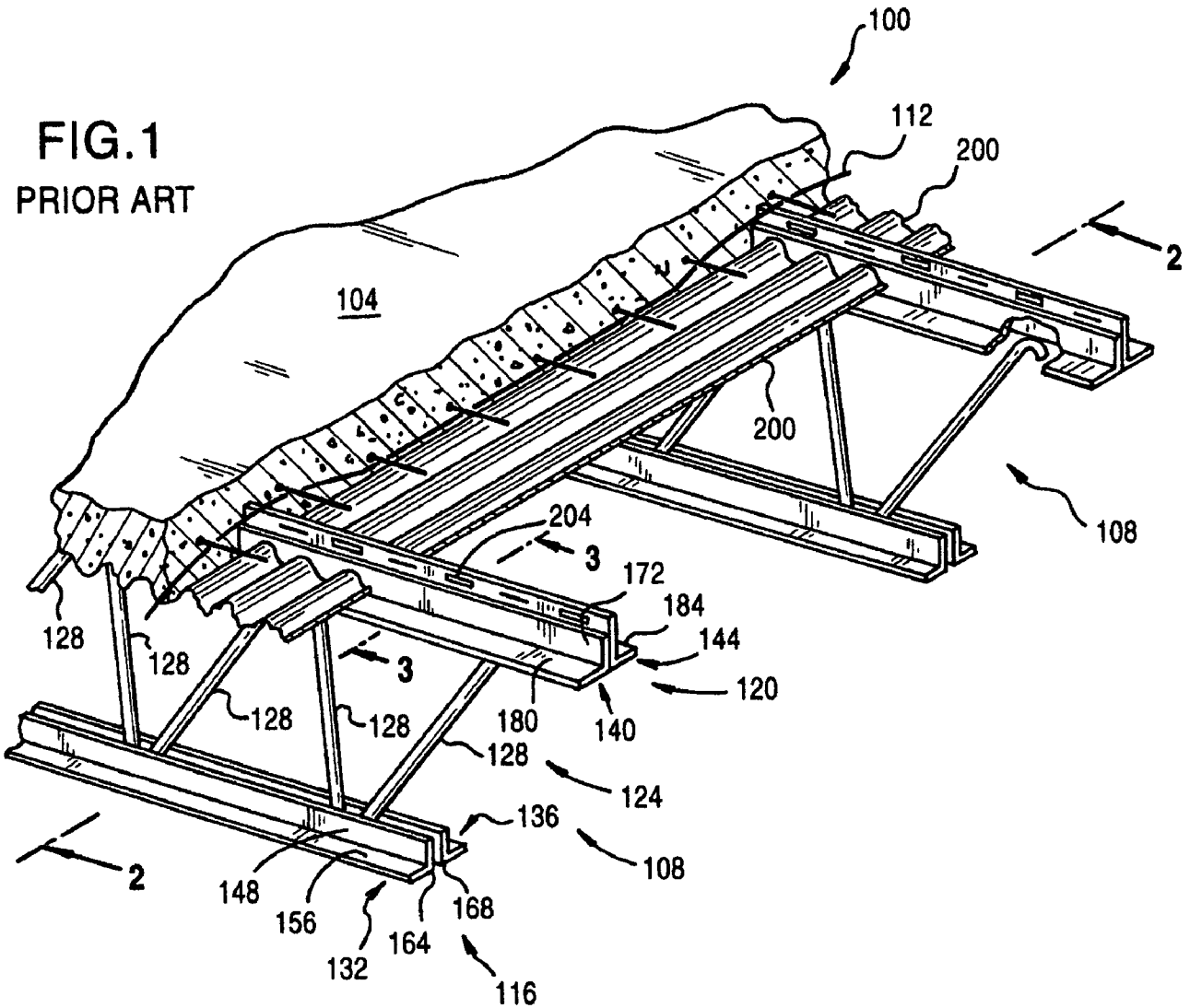
FIG. 1 PRIOR ART
FIG. 1 is a perspective view of a prior art composite slab and joist assembly.
Figure 2:
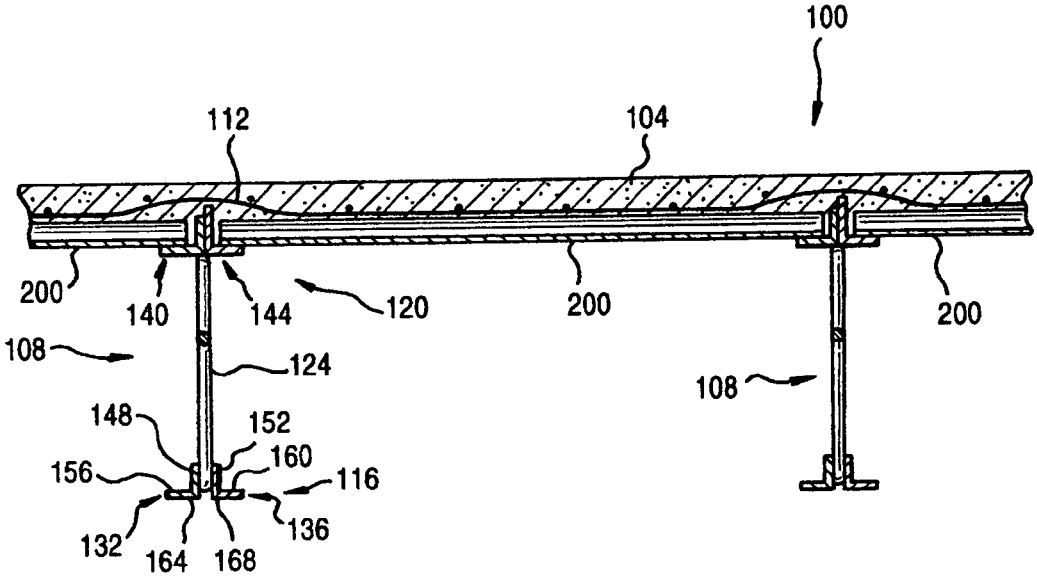
FIG.2 PRIOR ART
FIG. 2 is a cross-sectional view of the prior art assembly of FIG. 1.
Figure 3:
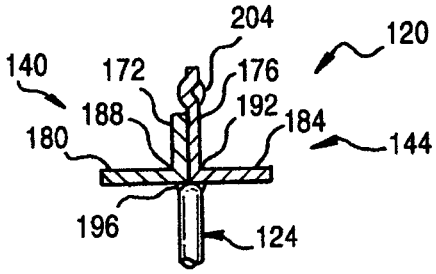
FIG.3 PRIOR ART
FIG. 3 is an alternate cross-sectional view of the prior art assembly of FIG. 1.
Figure 4:
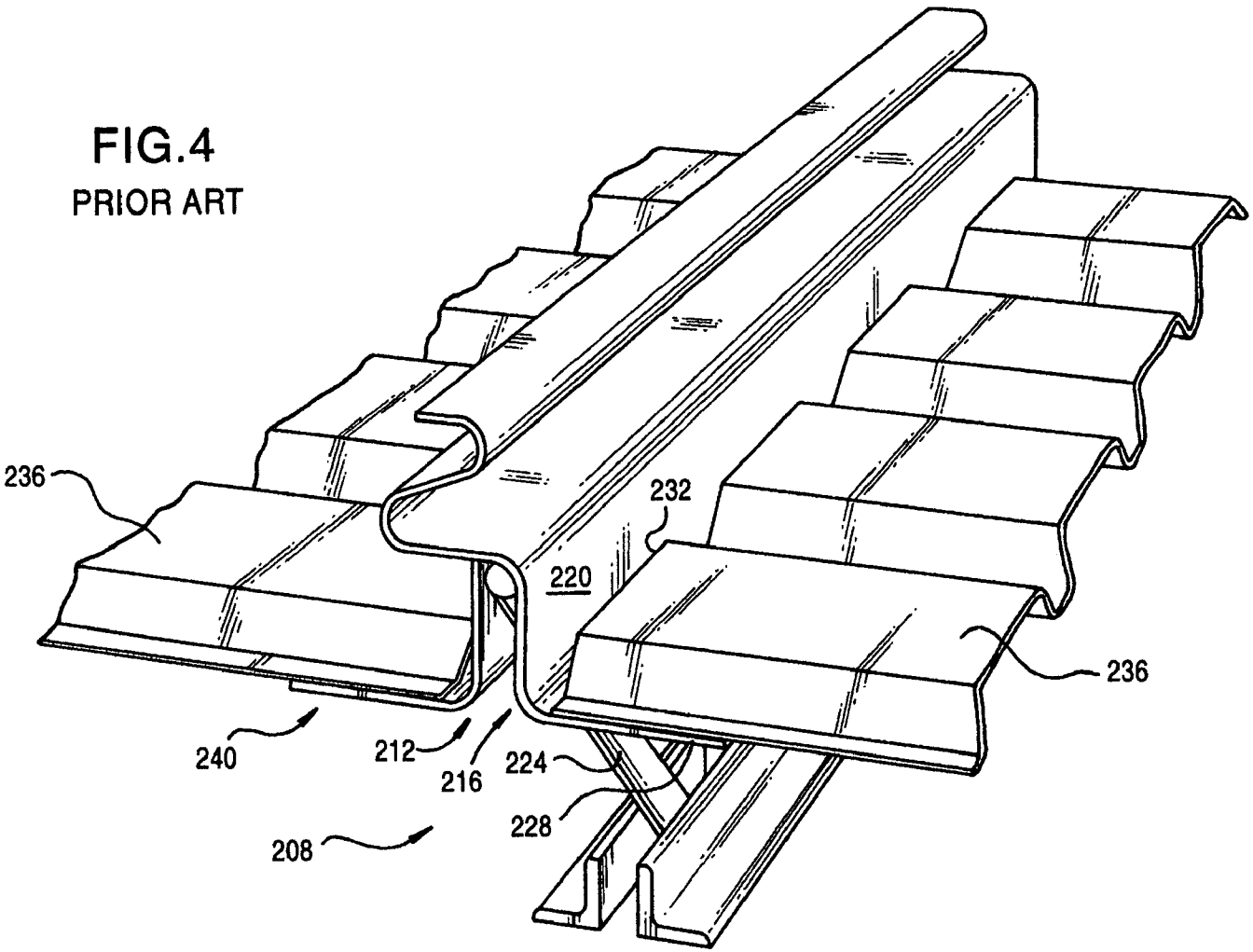
FIG.4 PRIOR ART
FIG. 4 is a perspective view of an alternate prior art assembly.
Figure 5:
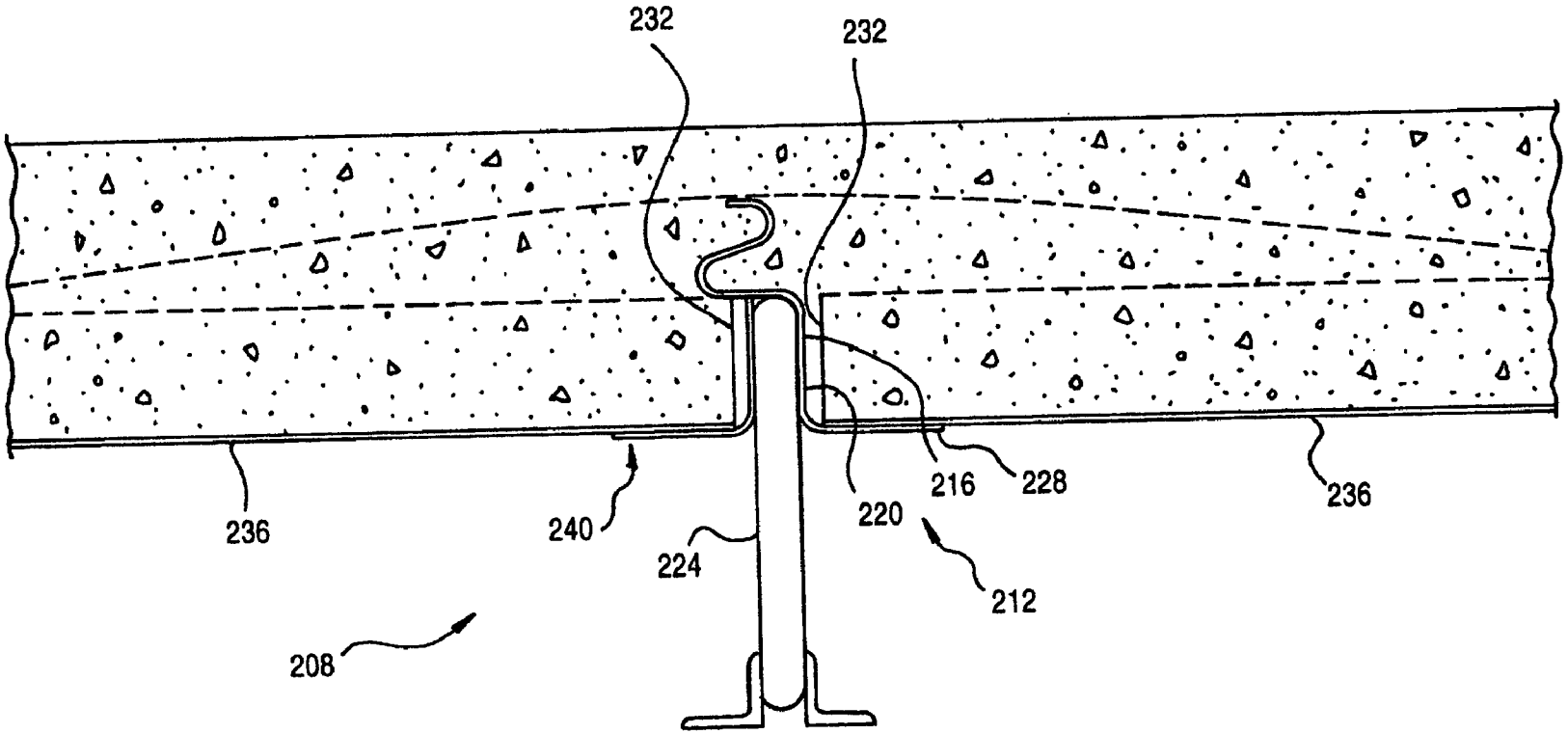
FIG.5 PRIOR ART
FIG. 5 is a cross-sectional view of the prior art assembly of FIG. 4 (with additional elements featured)
Figure 6:
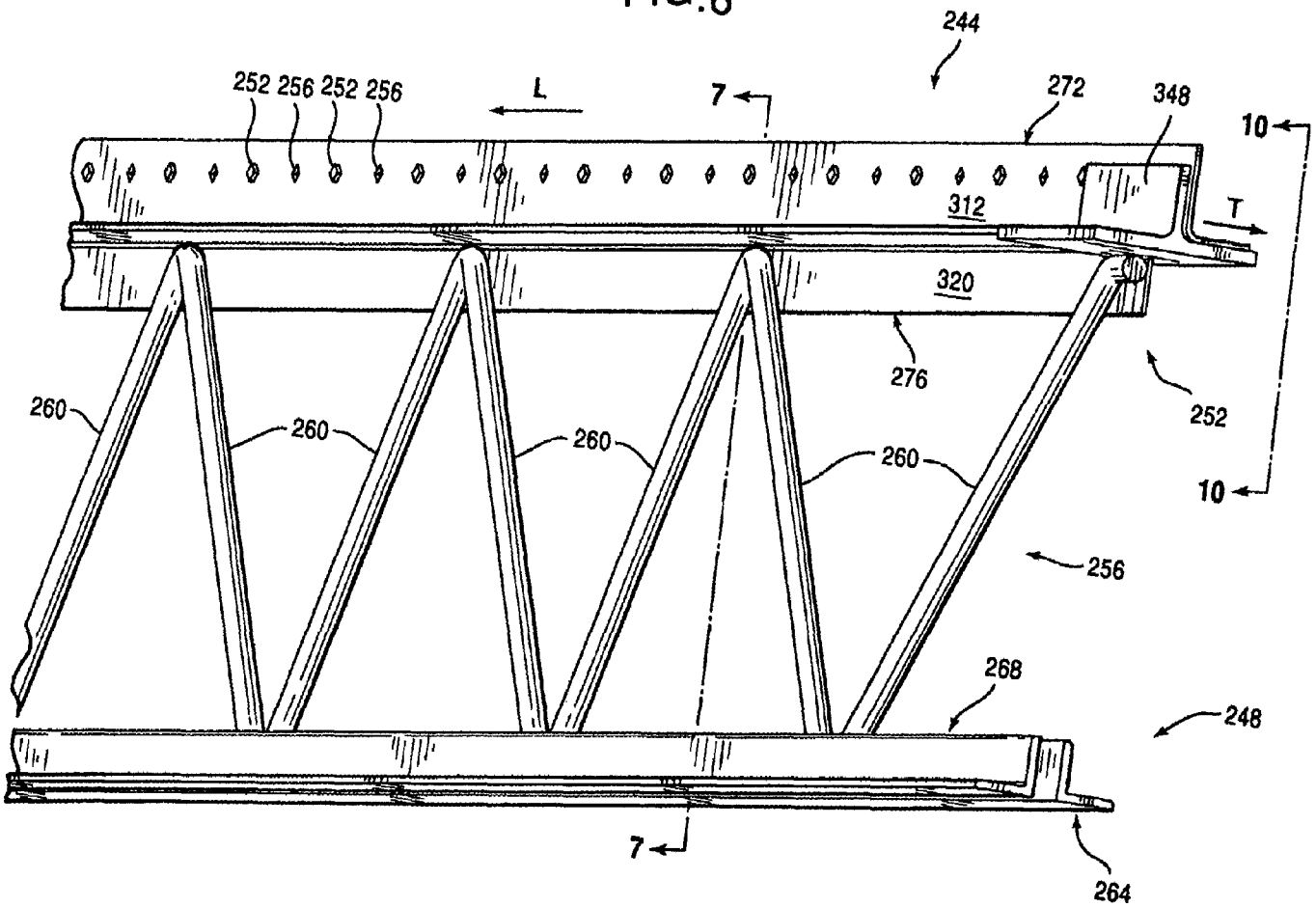
FIG. 6 is a perspective view of a joist in accordance with one embodiment of the present invention.

As illustrated in FIG. 6, a preferred embodiment of a joist 244 configured in accordance with the present invention includes a bottom chord 248, a top chord 252, and in open web 256 affixed therebetween. Web 256 of this embodiment is formed of a series of adjacent triangulating compression and tension members 260. Bottom chord 248 and top chord 252 are each formed of first and second elongated structural angles 264,268 and 272,276, respectively, extending in a longitudinal direction L. Structural angles 264,268 may be formed of of steel or composites (glass fibers and resins).

Figure 7A:
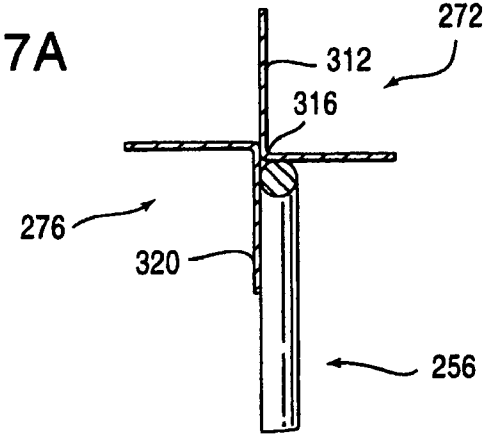
FIG. 7A is a cross-sectional view of an alternate embodiment of the joist of FIG. 7.
Figure 7B:
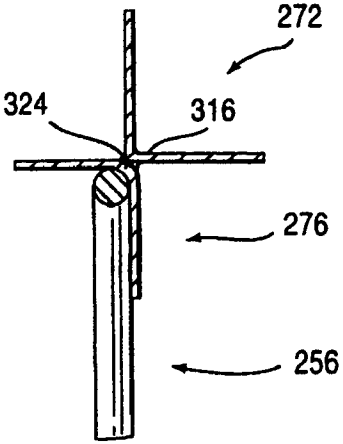
FIG. 7B is a cross-sectional view of an second alternate embodiment of the joist of FIG. 7.
Figure 7:
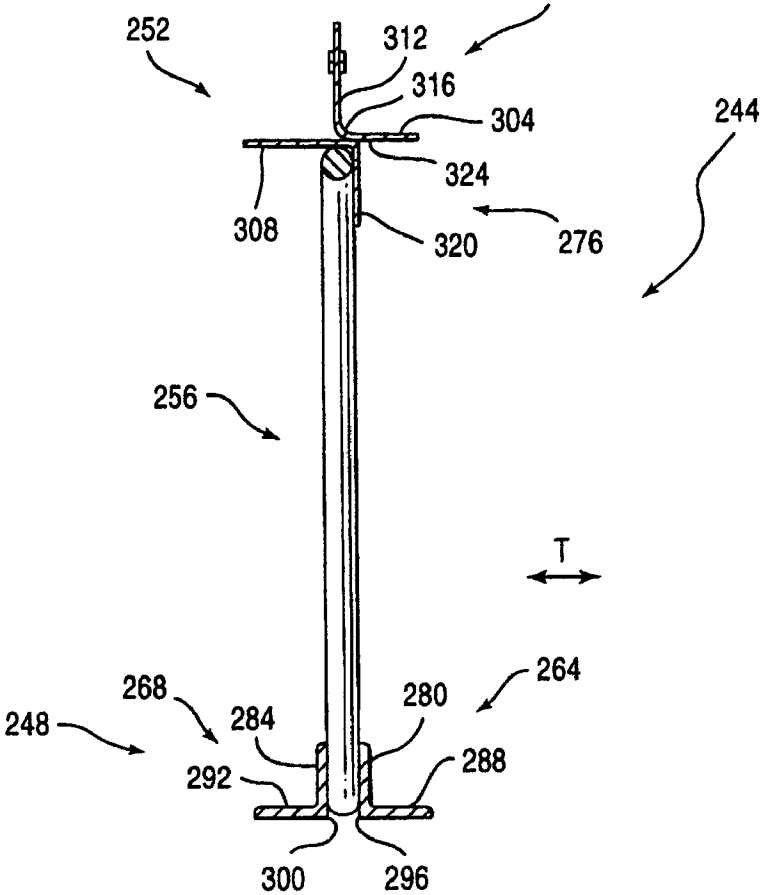
FIG. 7 is a cross-sectional view of the joist of FIG. 6.

With additional reference to the cross-section of FIG. 7, bottom chord structural angles 264,268 are oriented so that each has in cross-section an upwardly-extending leg 280, 284 and a horizontally-extending leg 288,292 meeting at a corner 296,300. Structural angles 264,268 are joined in a parallel relationship at the same height to opposite sides of a bottom portion of web 256. Web 256 joins structural angles 264,268 along the surfaces of upwardly-extending legs 280,284. Structural angles 264,268 are situated such that horizontally-extending legs 288,292 extend outwardly from web 256 in a traverse direction T.

Top chord structural angles 272,276 are oriented so that each has in cross-section a horizontally-extending leg 304, 308. First structural angle 272 has also has an upwardly-extending leg 312, which meets horizontally-extending leg 304 at a corner 316. Second structural angle 276 has a downwardly-extending leg 320, which meets horizontally-extending leg 308 at a corner 324. An upper portion of web 256 is joined to second structural angle 276 against downwardly-extending leg 320, and first structural angle 272 is joined to second structural angle 276.

As shown perhaps most clearly in the cross-sectional view of FIG. 7, first structural angle 272 of top chord 252 is joined to second structural angle 276 in a "top-to-bottom" relationship. In this configuration, a portion of horizontally-extending leg 308 of second structural angle 276 is positioned between the upper portion of web 256 and a portion of horizontally-extending leg 304 of first structural angle 272. With structural angles 272 and 276 joined in a top-to-bottom relationship, the upper portion of web 256 abuts corner 324 of second structural angle 276.

Structural angles 272 and 276 need not be joined in a top-to-bottom relationship to remain within the scope of the present invention. Other embodiments of the present invention implement "back-to-back" and "corner-to-corner" relationships, which are described as follows with reference to FIGS. 7A and 7B:

In the alternate embodiment represented in FIG. 7A, first structural angle 272 is joined to second structural angle 276 in a "back-to-back" relationship. In this configuration, a portion of downwardly-extending leg 320 of second structural angle 276 abuts a portion of upwardly-extending leg 312 of first structural angle 272. With structural angles 272 and 276 joined in a back-to-back relationship, the upper portion of web 256 abuts corner 316 of first structural angle 272.

In the alternate embodiment represented in FIG. 7B, first structural angle 272 is joined to second structural angle 276 in a "corner-to-corner" relationship. In this configuration, corner 316 of first structural angle 272 abuts corner 324 of second structural angle 276. With structural angles 272 and 276 joined in a corner-to-corner relationship, the upper portion of web 256 abuts corner 324 of second structural angle 276.

As shown above with reference to FIGS. 7, 7A, and 7B, structural angle may be joined together in top-to-bottom, back-to-back, and corner-to-corner relationships, and the joist configuration remains within the scope of the invention. In each configuration, the structural angles form, in cross-section, a substantially "plus" symbol. The structural angles may be connected to each other by welding, and the welding process may be automated. Also, the vertical or horizontal overlap of the structural angles may vary to reduce eccentricity or to accommodate special conditions, such as increasing slab thickness on one side of the joist.

An alternate embodiment joist top chord is illustrated in FIG. 8. Here, joist 328 has a top chord 332, wherein a first structural angle 336 has an upwardly-extending leg 340 in which a top portion has in cross-section a bend 344. (Bend 344 may also be referred to as a "return" or a "hook.") Such a configuration can be used to stiffen upwardly-extending leg 340 and increase the surface area of contact between the structural angle and slab material without increasing the height of top chord 332.

Figure 11:
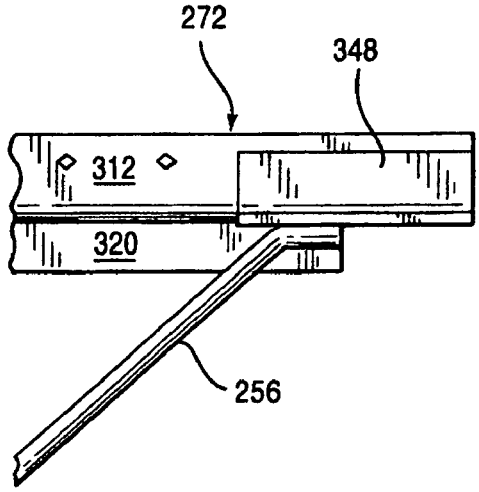
FIG. 11 is a side view of the shoe attached to the joist, the figure corresponding to the perspective view of FIG. 9.
Figure 12:
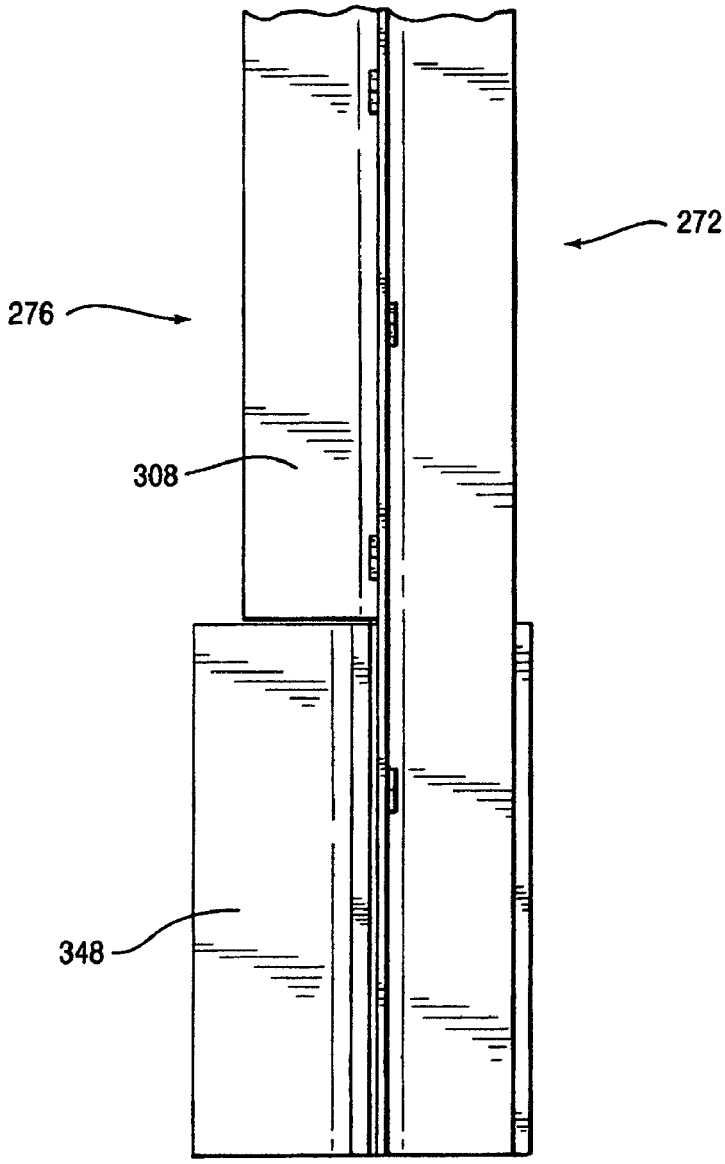
FIG. 12 is a top view of the shoe attached to the joist, the figure corresponding to the perspective view of FIG. 9.

The joist of the present invention may also include a shoe attached to a longitudinal end of its top chord to provide a bearing seat for the joist. FIG. 6 shows a shoe 348 in the upper-right quadrant of the drawing. FIG. 9 illustrates shoe 348 on joist 244 from more of a top perspective. FIG. 10 provides an end view of shoe 348 in place on joist 244, FIG. 11 provides a side view, and FIG. 12 provides a top view.

Figure 13:
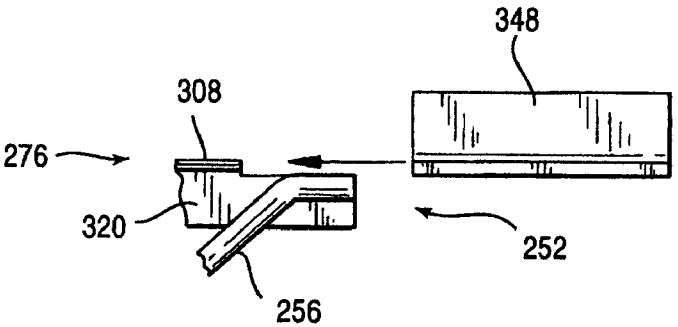
FIG. 13 is a side view of the shoe being inserted into a slot of the joist to form the view shown in FIG. 1.

In a preferred embodiment, shoe 348 may be formed from a "bisected" hot-rolled I-beam, having a T-shaped cross-section. As shown in FIG. 13 (first structural angle 272 not illustrated for clarity), horizontally-extending leg 308 of second structural angle 276 is coped, that is, a portion is removed, at a longitudinal end of top chord 252, thereby forming a slot in top chord 252 to receive shoe 348. In this embodiment, shoe 348 is attached to first and second structural angles 272, 276 to be flush with a longitudinal end of first structural angle 272. Shoe 348 is also attached to web 256.

By attaching shoe 348 to the end or top chord 252 as described, joist 244 can better accommodate high end reactions and shear at positions near the supporting members (for example, girders, beams, or walls) on which joist 244 rests. By connecting shoe 348 to both web 256 and top chord 252, shear loads are more easily transferred to the supporting members.

Another aspect of the present invention relates to the configuration of first structural angle 272 of top chord 252. With reference to FIG. 6, upwardly-extending leg 312 has a series of transverse protrusions 352 and indentations 356 (may also be referred to as "deformations") to use for engaging concrete when joist 244 is later assembled with a slab (discussed below). In the featured embodiments, the deformations are diamond-shaped; however, other shapes may be used.

A protrusion 252 on one side of upwardly-extending leg 312 has a corresponding indentation 256 located transversely on the opposite side. As shown in the drawings, each protrusion 252 and corresponding indentation 356 are located at the same longitudinal position along the length of top chord 252. In one preferred embodiment, protrusions 352 and indentations 356 alternate along the length of top chord 252 such that, on a particular side of upwardly-extending leg 312, protrusions 352 are longitudinally adjacent indentations 356, and indentations 356 are longitudinally adjacent protrusions 352. Protrusions 352 and indentations 356 may be added to first structural angle 272 by stamping upwardly-extending leg 312 accordingly.

Figure 14:
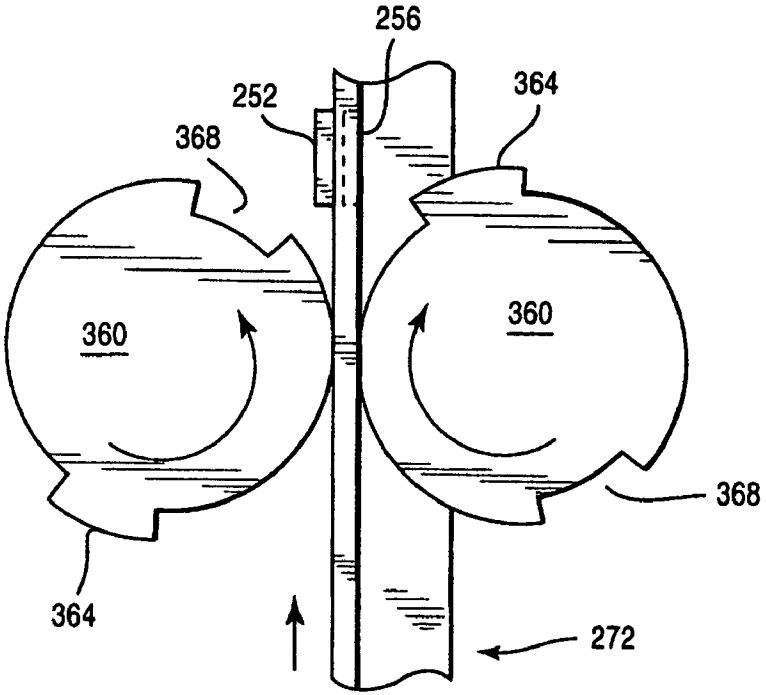
FIG. 14 is a top view of counter-rotating dies adding protrusions and indentations to a structural angle, which may be used to foam the joists of FIGS. 6–13.

Alternatively, protrusions 252 and indentations 256 may be added by inserting first structural angle 272 between a pair of counter-rotating dies 360 as illustrated in the top view of FIG. 14. The arrows in FIG. 14 indicate the direction of insertion of first structural angle 272 and the directions of rotation of dies 360. As shown, each of dies 360 has at least one protrusion 364 and at least one indentation 368. Dies 360 are arranged so that a protrusion 364 from one die 360 and an indentation 368 from the other die 360 simultaneously deform first structural angle 272 therebetween to add a protrusion 352 and a corresponding indentation 356.

Another aspect of the present invention relates to the suitability of the structural angles of the top chord for splicing. To increase top chord length, structural angles may bc connected end-to-end, for example, by welding, and the process may be automated.

Figure 15:
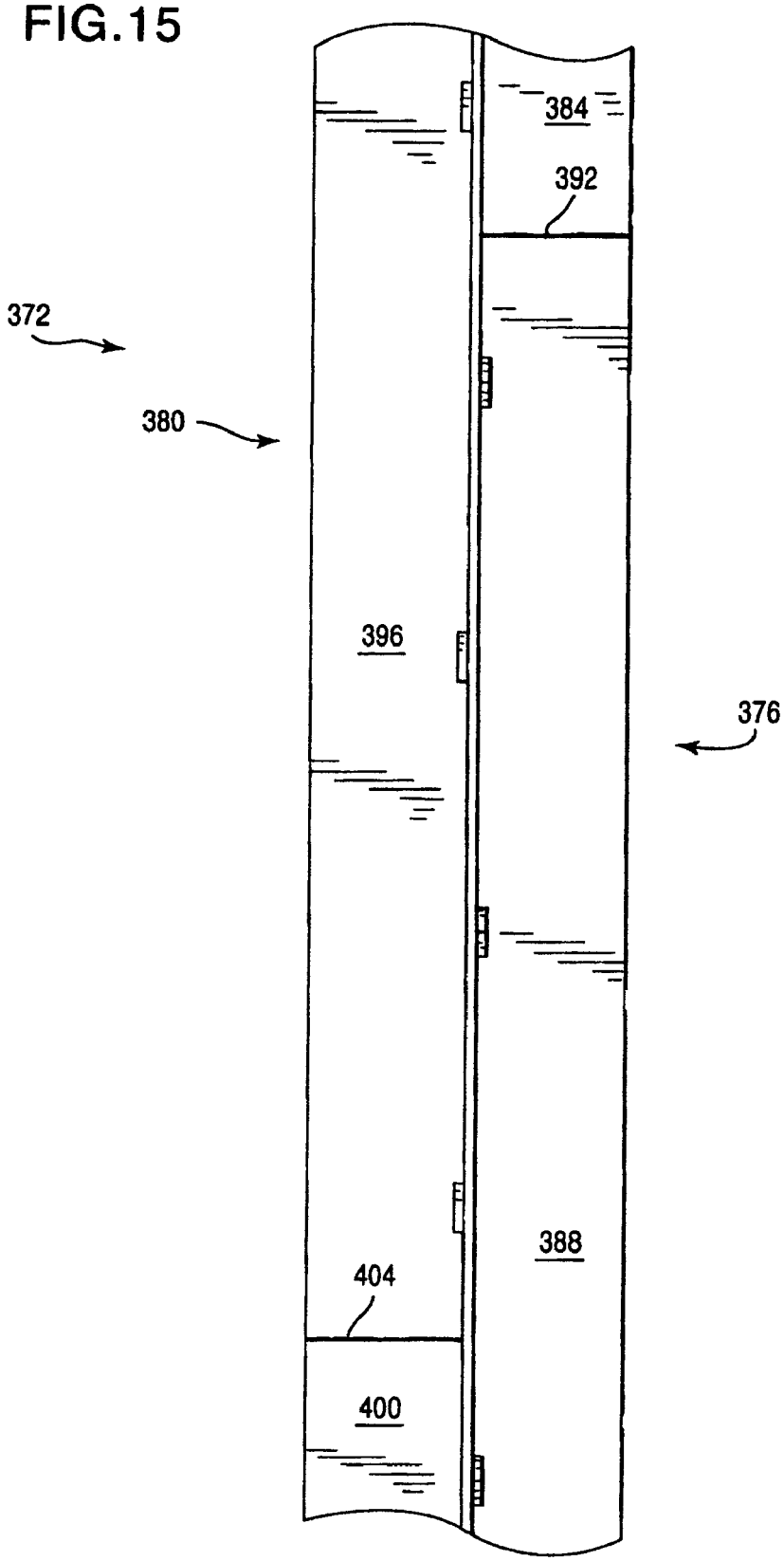
FIG. 15 is a top view of a spliced top chord, which may be used to form the joists of FIGS. 6–13.

Reference is made to the top view of FIG. 15, which provides a top view of a spliced top chord 372. Top chord 372 comprises a first structural angle 376 and a second structural angle 380. First structural angle 376 has a first part 384 and a second part 388, which are joined at first splice 392. Second structural angle 380 has a first part 396 aid a second part 400, which are joined at second splice 404. In a preferred embodiment, splices 392 and 404 are longitudinally offset along the length of top chord 372. Note that, although two spliced structural angles are shown, top chord 372 may be configured to have only one spliced structural angle. Note additionally that, unlike a bottom chord that undergoes tension, top chord 372 undergoes compression, and the first and second parts of the top chord structural angles may be butt-welded. Also, an additional splice plate is unnecessary, because a splice in one structural angle is offset from an unspliced region of the other structural angle. Therefore, the unspliced region functions as a splice plate.

An exemplary implementation for spliced top chords may occur if 40-foot structural angles were commercially available to form 25-foot joists. To form the joists, 40-foot structural angles would be cut into 25-foot structural angles and 15-foot structural angles. The 25-foot structural angles would be ready for forming chords. The 15-foot structural angles would be spliced to form 30-foot structural angles and then cut into 25-foot structural angles and 5-foot structural angles. The spliced 25-foot structural angles would be arranged so that the splices would be longitudinally, offset and then joined to form a top chord. Of course, spliced 25 foot structural angles can be joined to unspliced 25 foot structural angles to form the top chord.

Figure 16:
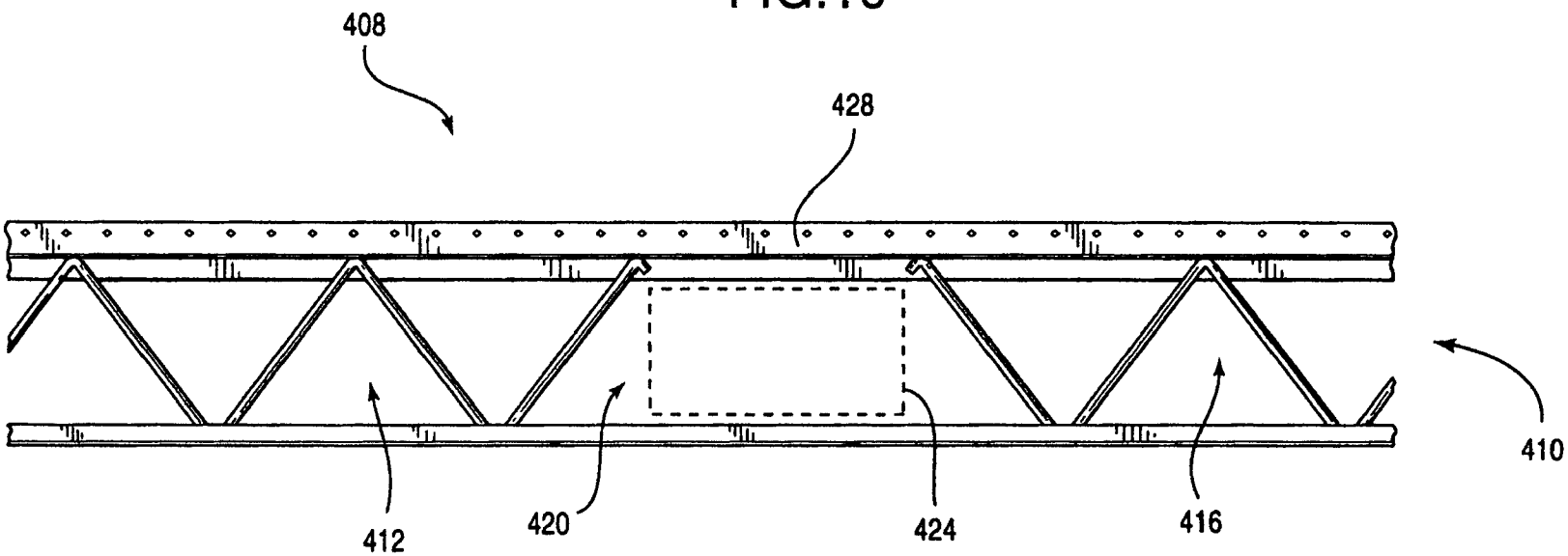
FIG. 16 is a side view of an alternate embodiment of the joist of FIG. 6.

An alternative embodiment of the joist of the present invention may comprise a web that has gap separating two series of adjacent compression and tension members. The gap provides a larger area for which to insert items such as ventilation ducts or piping. As shown in the side view of FIG. 16, joist 408 has a web 410 comprising two series of adjacent compression and tension members 412 anal 416 with a gap 420 therebetween. The dashed line box 424 indicates the increased area for which to insert ducts or other items. One of the top chord structural angles has a downwardly-extending leg 428, and downwardly-extending leg 428 provides a convenient mounting surface for reinforcing plates or for framed opening angles that would attach a duct or other item to the joist.

Figure 17:
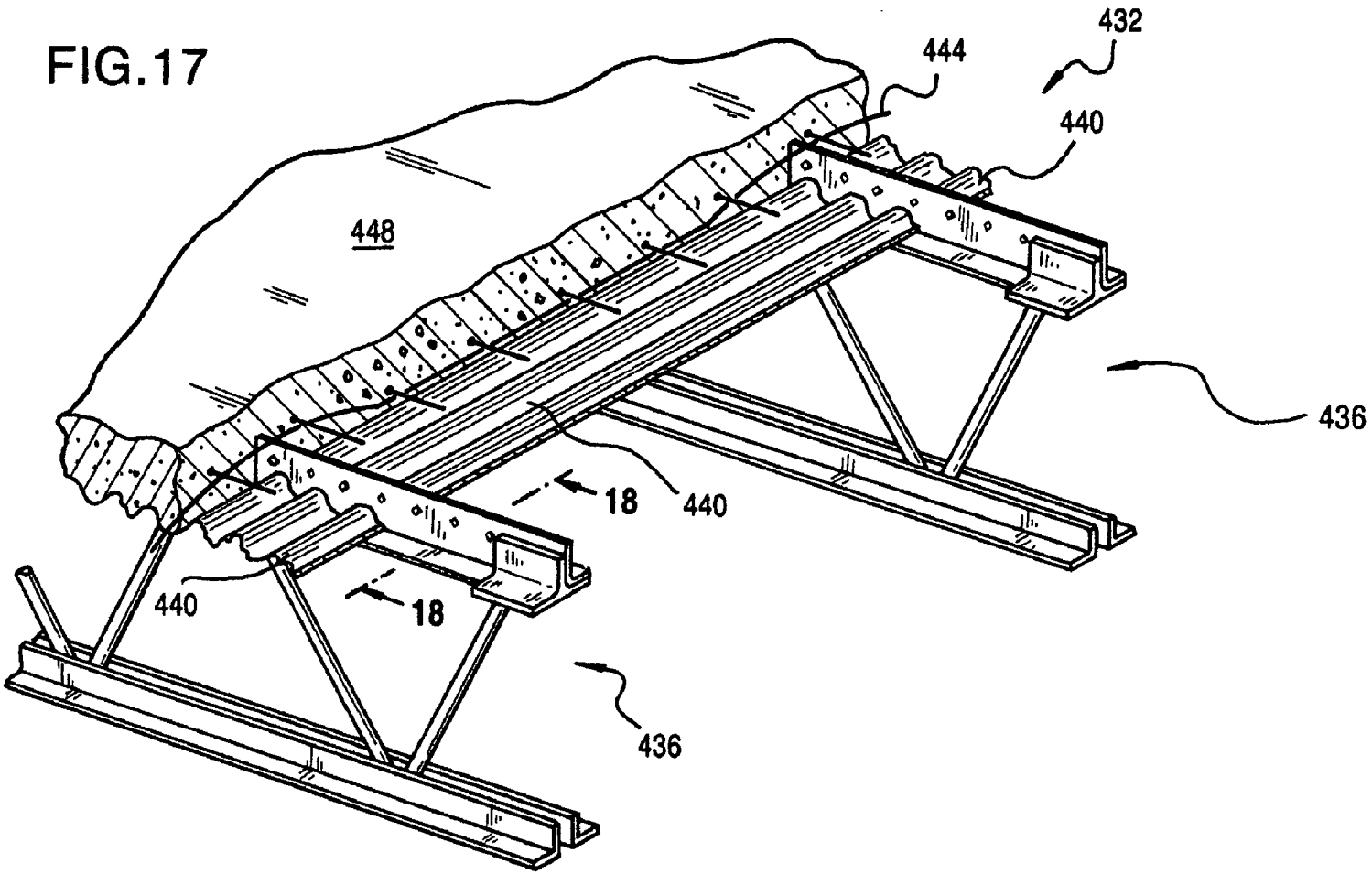
FIG. 17 is a perspective view of a composite slab and joist assembly in accordance with one embodiment of the present invention such that the assembly may include the joists of the above figures.
Figure 18:
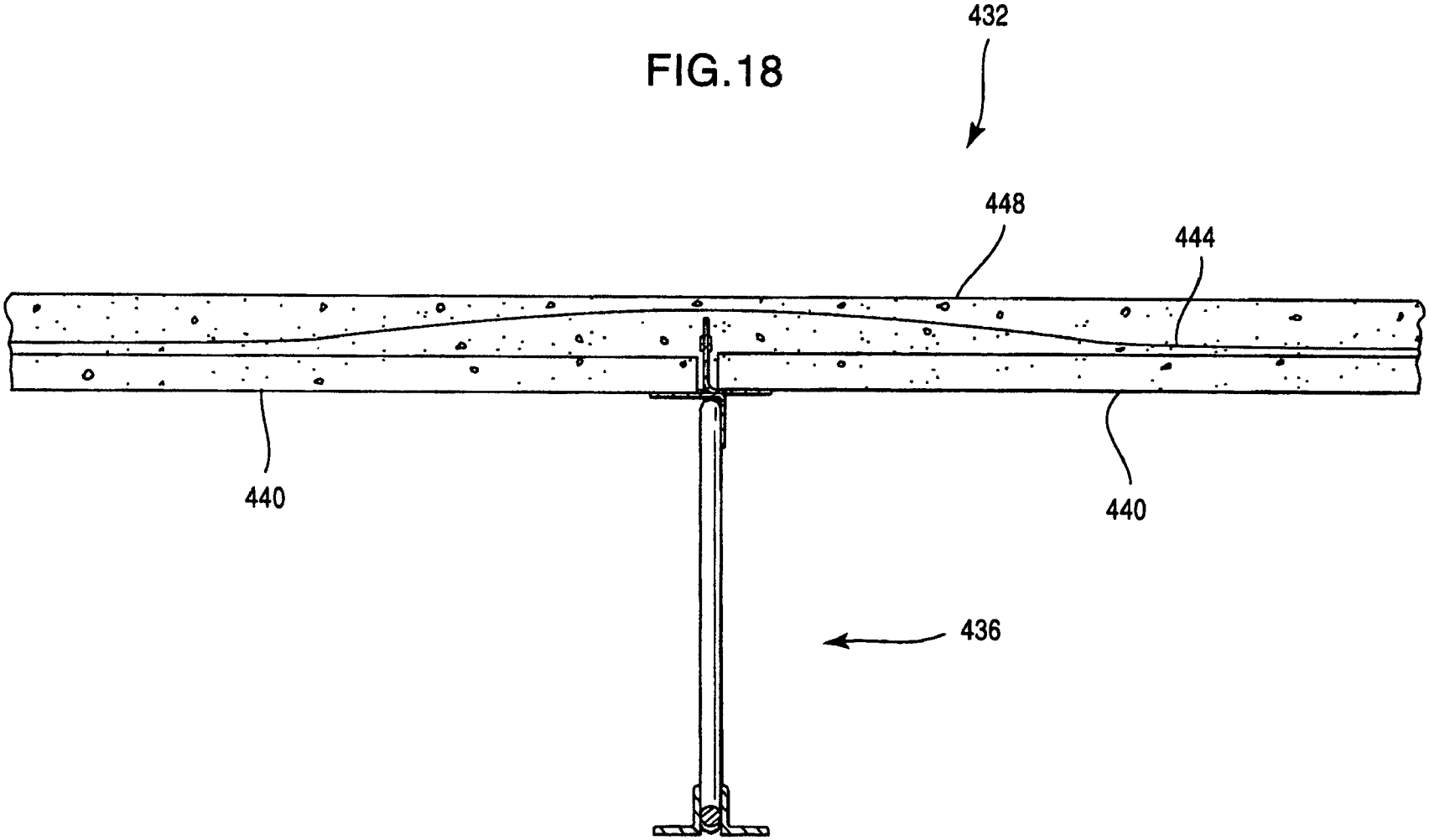
FIG. 18 is a cross-sectional view of the assembly of FIG. 17.

Another preferred embodiment of the present invention is a composite slab and joist assembly 432, as illustrated in perspective in FIG. 17 and in cross-section in FIG. 18. Assembly 432 can be used to form a floor, roof, or ceiling structure. Assembly 432 comprises joists 436 spaced apart on supporting members. Joists 436 may be configured like any of the joists described above with respect to other embodiments of the present invention.

Deck panels 440 are positioned between adjacent joists 436 to rest on the horizontally-extending legs of the structural angles of the top chords. Deck panel 440 may be corrugated composite metal form deck panels and may have dimples for engaging concrete. Deck panels 440 are secured to the top chords, for example, by screws, powder actuated fasteners, or welds. By structurally fastening deck panels 440 to the horizontally-extending legs of the structural angles, deck panels 440 add to the interface shear connection between the joists 436 and a concrete slab (discussed below).

Slab reinforcement 444 is positioned above joists 436 and deck panels 440. Slab reinforcement 444 may be a mesh, which is sometimes referred to as "welded wire fabric" or "WWF." Sometime, a set of bars is used as reinforcement. In this embodiment, slab reinforcement 444 initially contacts both joists 436 and deck panels 440. A slab of concrete 448 is formed on deck panels 440 and on top of joists 436. Before the concrete sets, deck panels 440 may be vibrated in a fashion known to those skilled in the art so that wet concrete will penetrates below slab reinforcement 444. Slab 448 encloses slab reinforcement 444 and a top portion of joists 436.

In this embodiment, joists 436 have protrusions and indentations in the upwardly-extending legs of one of the structural angles of the top chord. These protrusions and indentations engage the concrete of slab 448 and act as sheer connectors to transfer compression forces from the top chord to concrete slab 448. Also, the upwardly-extending legs act as high-chairs to raise slab reinforcement 444 to a position higher than that at a location between adjacent joists 436. Thus, the upwardly-extending legs effect negative slab reinforcement.

Additionally, in this embodiment, deck panels 440 compliment the strength of slab 448. Therefore, slab 448 need not made as thick to provide adequate strength for the given building need.

Having thus described example embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

We claim:

1. A joist comprising:

a bottom chord, a top chord, and a web affixed therebetween, wherein said top chord has a first elongated structural angle and a second elongated structural angle, said first structural angle having in cross-section a horizontally-extending leg and an upwardly-extending leg meeting at a corner, said second structural angle having in cross-section a horizontally extending leg and a downwardly-extending leg meeting at a corner, wherein an upper portion of said web is joined to said top chord second structural angle against said downwardly-extending leg, and said first structural angle is joined to said second structural angle, wherein a top portion of said upwardly-extending leg of said first structural angle has in cross-section a bend.

2. A joist comprising:

a bottom chord, a top chord, and a web affixed therebetween, wherein said top chord has a first elongated structural angle and a second elongated structural angle, said first structural angle having in cross-section a horizontally-extending leg and an upwardly-extending leg meeting at a corner, said second structural angle having in cross-section a horizontally-extending leg and a downwardly-extending leg meeting at a corner, wherein an upper portion of said web is joined to said top chord second structural angle against said downwardly-extending leg, and said first structural angle is joined to said second structural angle, a shoe attached to a longitudinal end of said top chord, wherein said shoe has a T-shaped cross-section, and wherein said top chord second structural angle, at said longitudinal end of said top chord, is coped to allow said shoe to be attached to and first and second structural angles to be flush with a longitudinal end of said first structural angle.

3. A joist comprising:

a bottom chord, a top chord, and a web affixed therebetween, wherein said top chord has a first elongated structural angle and a second elongated structural angle, said first structural angle having in cross-section a horizontally-extending leg and an upwardly-extending leg meeting at a corner, said second structural angle having in cross-section a horizontally-extending leg and a downwardly-extending leg meeting at a corner, wherein an upper portion of said web is joined to said top chord second structural angle said downwardly-extending leg, and said first structural angle is joined to said second structural angle, wherein said upwardly-extending leg of said first structural angle has a series of transverse protrusions and indentations, whereby a protrusion on one side of said upwardly-extending leg has a corresponding indentation located transversely on the opposite side of said upwardly-extending leg, and said protrusion and corresponding indentation are each located at the same longitudinal position along the length of said top chord.

4. The joist of claim 3, wherein on each side of said upwardly-extending leg of said first structural angle, said protrusions are longitudinally adjacent said indentations and said indentations are longitudinally adjacent said protrusions.

5. A joist comprising:

a bottom chord, a top chord, and a web affixed therebetween, wherein said top chord has a first elongated structural angle and a second elongated structural angle, said first structural angle having in cross-section a horizontally-extending leg and an upwardly-extending leg meeting at a corner, said second structural angle having in cross-section a horizontally-extending leg and a downwardly-extending leg meeting at a corner, wherein an upper portion of said web is joined to said top chord second structural angle against said downwardly-extending leg, and said first structural angle is joined to said second structural angle, at least one splice in one of said structural angles of said top chord, further comprising:

at least two splices, said first structural angle having one of said splices and said second structural angle having another of said splices, wherein said at least two splices are longitudinally offset along the length of said top chord.

6. In steel and concrete structures having at least one pair of spaced-apart parallel joists, each of which includes at least a top chord, and wherein a wooden form is normally mounted between the respective top chords of the pair of joists for subsequently pouring a concrete slab therebetween, the wooden form subsequently being removed once the concrete has cured, the improvement wherein the top chord of each joist comprises two complementary structural angles including first and second structural angles secured to each other, the first structural angle having an upwardly-extending leg and a horizontally-extending leg forming a first corner therebetween, the second structural angle having a downwardly-extending leg and further having a horizontally-extending leg forming a second corner therebetween the horizontally-extending leg of the second structural angle extending in a direction oppositely of the horizontally-extending leg of the first structural angle, the first and second angle members being disposed such that their respective corners substantially engage or confront one another, thereby forming in cross-section a substantially "plus" symbol, a panel permanently mounted horizontally between the pair of joists, thereby providing a concrete form, and concrete poured over the panel to form a slab, thereby eliminating the necessity of constructing, and subsequently removing, the wooden form between the pair of joists.

7. The improvement of claim 6, wherein the panel comprises a metal corrugated panel.

8. The improvement of claim 6, wherein the respective upwardly-extending legs of the first structural angles have alternately disposed protrusions and indentations, respectively, thereby improving the bonding of the joists to the concrete slab.

9. The improvement of claim 6, wherein each joist further includes a bottom chord connected to the top chord by a web.

10. The improvement of claim 9, wherein the web includes compression and tension members, each of which has an upper end and a lower end, the respective upper ends being connected to the downwardly-extending leg of the second structural angle, thereby providing improved structural integrity.

11. The improvement of claim 10, wherein each joist further includes a bottom chord comprising a pair of complementary structural angles having respective upwardly-extending spaced-apart legs for securing therebetween the lower ends of the respective compression and tension members of the web.

12. the improvement of claim 6, wherein the structure includes girders, beams, or walls on which the joists are supported, and wherein a reinforcing shoe is disposed at the respective ends of the joists and contact the girders, beams, or walls of the structure.

13. In a building structure having at least a first joist which includes a top chord a bottom chord and a web therebetween the web including compression and tension members, each of which has respective upper and lower ends, the improvement in which the top chord includes at least one structural angle having a horizontally-extending lea and a forwardly-extending leg, and wherein the respective upper ends of the tension and compression members of the web are secured to the downwardly-extending leg of the structural angle, further including an additional structural angle having an upwardly-extending leg and further having a horizontally-extending leg disposed oppositely to the horizontally-extending leg of the other structural angle, both structural angles members being connected thereto to form, in cross-section, a substantially "plus' configuration.

14. The improvement of claim 13 further including a second joist parallel to and spaced apart from the first joist, wherein a corrugated metal panel is secured between the respective top chords of the first and second joists, and wherein a concrete slab is poured over the corrugated metal panel and between the respective top chords of the first and second joists.

15. The improvement of claim 14, wherein the respective upwardly-extending legs of the additional structural angles of the top chords of the joists have respective alternating protrusions and indentations, thereby improving the bonding of the joists to the concrete slab.

* * * * *